US009469127B2

(12) United States Patent
Wetjens et al.

(10) Patent No.: US 9,469,127 B2
(45) Date of Patent: Oct. 18, 2016

(54) METHOD FOR APPLYING AN IMAGE OF A RADIATION CURABLE PHASE CHANGE INK

(71) Applicant: OCE-TECHNOLOGIES B.V., Venlo (NL)

(72) Inventors: Peter M. A. Wetjens, Sevenum (NL); Gerardus C. P. Vercoulen, Velden (NL); Hendrik J. A. Ogrinc, Velden (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/965,351

(22) Filed: Dec. 10, 2015

(65) Prior Publication Data

US 2016/0096379 A1 Apr. 7, 2016

Related U.S. Application Data

(63) Continuation of application No. PCT/EP2014/063168, filed on Jun. 23, 2014.

(30) Foreign Application Priority Data

Jun. 26, 2013 (EP) ..... 13173793

(51) Int. Cl.

| | |
|---|---|
| ***B41J 2/01*** | (2006.01) |
| ***B41J 11/00*** | (2006.01) |
| ***B41M 5/00*** | (2006.01) |
| ***B41M 7/00*** | (2006.01) |

(52) U.S. Cl.
CPC ..... *B41J 11/0015* (2013.01); *B41J 11/002* (2013.01); *B41M 5/0011* (2013.01); *B41M 7/0081* (2013.01)

(58) Field of Classification Search
CPC ..... B41J 11/002; B41J 2002/16564
See application file for complete search history.

(56) References Cited

U.S. PATENT DOCUMENTS

| | | | | |
|---|---|---|---|---|
| 7,988,259 | B2 * | 8/2011 | Hishida | B41J 3/28 347/102 |
| 8,105,659 | B2 | 1/2012 | Chretien et al. | |
| 2011/0221845 | A1 * | 9/2011 | Ue | B41J 11/0085 347/104 |
| 2012/0274716 | A1 | 11/2012 | McConville et al. | |

FOREIGN PATENT DOCUMENTS

| | | |
|---|---|---|
| EP | 1 260 368 A1 | 11/2002 |
| WO | WO 2011/061136 A1 | 5/2011 |

* cited by examiner

*Primary Examiner* — Julian Huffman
(74) *Attorney, Agent, or Firm* — Birch, Stewart, Kolasch & Birch, LLP

(57) ABSTRACT

The invention relates to a method for applying an image onto a receiving medium, wherein the gloss of the image is controlled by controlling the temperature of the receiving medium. The invention further relates to an ink jet apparatus. The invention further relates to a method for determining a job setting of a print job for obtaining an image having a desired gloss level.

7 Claims, 2 Drawing Sheets

METHOD FOR APPLYING AN IMAGE OF A RADIATION CURABLE PHASE CHANGE INK

CROSS REFERENCE TO RELATED APPLICATIONS

This application is a Continuation of PCT International Application No. PCT/EP2014/063168, filed on Jun. 23, 2014, which claims priority under 35 U.S.C. 119(a) to patent application Ser. No. 13/173,793.4, filed in Europe on Jun. 26, 2013, all of which are hereby expressly incorporated by reference into the present application.

The present invention relates to a method for applying an image onto a receiving medium using a radiation curable phase change ink. In addition, the invention relates to an ink jet apparatus for applying droplets of a radiation curable phase change ink composition onto a receiving medium. The invention also relates to a method for determining a job setting for a print job for obtaining an image having a desired gloss level.

BACKGROUND OF THE INVENTION

Methods for applying images onto a receiving medium using a radiation curable phase change ink are known in the art. Such methods typically include a step of curing the radiation curable ink composition. Curing of the ink composition may be done e.g. by irradiating the newly printed image with a suitable radiation source, such as a UV radiation source. The image obtained may have a certain gloss level. A high gloss level of an image corresponds to a glossy image whereas a low gloss level corresponds to a matt image. The gloss level may be influenced by several parameters, such as composition of the ink, or nature of the receiving medium, etc. However, it is desired to be able to tune the gloss level of the image in a flexible way. For example, if the gloss level is tuned by selecting an ink composition corresponding to the desired gloss, than the ink composition needs to be changed if the desired gloss level of two subsequent print jobs is different. This is time consuming and inefficient.

U.S. Pat. No. 8,105,659 discloses a method for applying an image onto a receiving medium using a UV curable ink, wherein the gloss of the image obtained is controlled by controlling an amount of oxygen in the air. However, this method requires control of the atmosphere around the printed image, and thus requires a complicated set up for applying the image.

Therefore, it is an object of the present invention to provide a method that mitigates the problem of the prior art. It is an object of the present invention to provide a method for applying an image onto a receiving medium using a radiation curable phase change ink, wherein the gloss of the image obtained can be suitably regulated.

SUMMARY OF THE INVENTION

The object is achieved in a method for applying an image onto a receiving medium, the method comprising the steps of:

a. applying droplets of a radiation curable phase change ink composition onto a receiving medium using an ink jet apparatus, the radiation curable phase change ink composition comprising a radiation curable component and the radiation curable phase change ink composition being fluid above a third temperature $T_3$;

b. controlling the temperature of the receiving medium to be at a temperature T, wherein $T<T_3$;

c. curing the radiation curable phase change ink composition;

wherein, if the temperature T is in between a first temperature $T_1$ and a second temperature $T_2$, a semi-gloss print is obtained;

if $T \leq T_1$, a gloss print is obtained;

if $T \geq T_2$, a matt print is obtained;

and wherein $T_1<T_2<T_3$.

In the method according to the present invention, droplets of a radiation curable composition are applied onto a receiving medium using an ink jet apparatus. The ink jet apparatus may comprise a print head. The print head may comprise an orifice, through which droplets of the radiation curable phase change ink are applied. The print head may further comprise a pressure chamber comprising a quantity of the ink. The print head may further comprise actuation means for generating a pressure in the fluid in the pressure chamber. Due to the pressure generated in the pressure chamber, a droplet of ink may be ejected. The ink jet may further comprise an ink reservoir.

The ink that is used in the method according to the present invention is a phase change ink. A phase change ink is an ink that is liquid at elevated temperature and is in a solid or semi-solid state at a lower temperature. For example, the phase change ink may be in the liquid phase at a temperature above $T_3$, $T_3$ may be e.g. 40° C.; 60° C.; 75° C. or 95° C. At lower temperatures, such as temperatures below $T_3$, the phase change ink may be in a phase different than the liquid phase. For example, the ink may be in the solid phase or in a semi-solid phase. An example of a semi-solid phase is a gelled phase. In the ink reservoir and in the pressure chamber, the ink may be in the fluid state and therefore may be at a temperature of at least $T_3$. To bring the ink at a temperature of at least $T_3$ and to maintain the desired temperature, the ink jet apparatus may be provided with heating means to heat the ink. For example, the ink reservoir may be provided with heating means to heat the phase change ink. Alternatively or additionally, the pressure chamber may be provided with heating means for heating the pressure chamber and the ink inside the pressure chamber.

The ink in accordance with the present invention is a radiation curable ink. Radiation curable inks are known in the art. Radiation curable inks are inks that comprise at least one radiation curable component. The radiation curable component may be curable upon irradiation of the ink, for example using UV radiation. Curing of the ink is also known in the art as hardening of the ink. Radiation curable components may be e.g. radiation curable monomers and/or oligomers. Non-limiting examples of radiation curable monomers are acrylate monomers, methacrylate monomers and epoxy monomers. The monomers may be monofunctional monomers (i.e. monomers comprising one radiation curable moiety), or the monomers may be multifunctional monomers (i.e. monomers comprising two or more radiation curable moieties).

The radiation curable ink composition may additionally comprise at least one photoinitiator for initiating curing (e.g. initiating a polymerization reaction) upon curing of the ink composition. The radiation curable ink composition may additionally comprise at least one inhibitor for preventing polymerization of the curable components of the ink.

The radiation curable ink composition may further comprise a colorant. The colorant may be a pigment, a mixture of pigments, a dye, a mixture of dyes, a mixture of a dye and a pigment or a mixture of more than one dye and more than one pigment. Pigments are preferred, because of their superior color fastness with respect to dyes.

The radiation curable ink composition may comprise at least one component that provides the ink composition with phase change properties. For example, the ink composition may comprise a component that solidifies at a temperature lower than $T_3$. For example, the ink may comprise a meltable wax. The meltable wax may be a liquid at a temperature above $T_3$ and may solidify at $T_3$. The meltable wax may be a reactive wax, such as a radiation curable wax or may be a non-reactive wax. A radiation curable wax may be a wax that comprises a functional chemical group that is capable of undergoing a polymerization reaction upon exposure to radiation. The radiation curable wax may comprise for example an acrylate functional group or a methacrylate functional group.

Incorporating a component that may solidify may result in the formation of a solidifiable ink, i.e. a hot melt ink. A hot melt ink is an example of a phase change ink. When a droplet of ink solidifies, the droplet may no longer flow and therefore, spread of a droplet and inter-droplet smearing may be prevented.

Additionally or alternatively, the ink composition may comprise a gelling agent. An ink comprising a gelling agent may be in the liquid phase above a gelling temperature of the gelling agent and may be in the gelled state below the gelling temperature of the gelling agent. The gelling temperature of the gelling agent may be $T_3$. The gelled phase is a phase wherein a gel exists as a dynamic equilibrium between a solid gellant and a fluid. The gel phase is a dynamic networked assembly of molecular components held together by non-covalent interactions. Upon formation of the gelled phase, the viscosity of the ink composition may increase. A higher viscosity prevents flow of the droplet. Thus, also gelling of a droplet of ink may prevent spread of a droplet and inter-droplet smearing.

Thus both gelling and solidification are suitable phase changes to prevent spread of a droplet and inter-droplet smearing and both phase changes may be suitably applied in an ink such as a radiation curable ink. In general, any phase change that diminishes the flowability of a droplet of ink upon cooling of the ink may be suitably applied.

The phase change property of the radiation curable ink may allow stabilizing the droplets applied onto the receiving medium before they are cured. E.g. when a phase change radiation curable ink is used for applying an image onto a receiving medium, it may not be necessary to cure immediately after the droplet has landed onto the receiving medium; there may be a time interval in between application of the droplets onto the receiving medium and curing, without droplet smearing occurring.

In step b, the temperature of the receiving medium is controlled to be at a temperature T, wherein temperature T is a temperature below $T_3$. Thus, after the ink has been applied onto the receiving medium in step a), the ink may cool down, because of the lower temperature of the receiving medium. Because the receiving medium is at a temperature T, which is a temperature below $T_3$, the ink composition that has been applied onto the receiving medium may cool down to a temperature T, which is below $T_3$. Since a phase change may occur at a temperature below $T_3$, the ink may no longer be in the fluid state after the droplet of ink has been applied onto the receiving medium. The phase change of the ink droplets may prevent the droplets from spreading over the receiving medium, thereby stabilizing the image applied onto the receiving medium.

The temperature of the receiving medium may be controlled by suitable temperature regulation means. The temperature regulation means may be configured to cool the receiving medium and/or heat the receiving medium. Any suitable type of temperature regulation means may be used. For example, an electrical heating or cooling may be used. Optionally, a cooling fluid, such as water, may be used.

In step c) the radiation curable phase change ink composition is cured. The radiation curable ink may be cured by irradiating the ink. The ink may be irradiated with suitable radiation, for example UV radiation. The radiation, such as the UV radiation may be provided by a suitable radiation source, such as a lamp, e.g. a UV lamp.

The radiation may induce a chemical reaction in the ink composition. For example, the radiation may initiate a polymerization reaction in the ink, which results in hardening of the ink composition, thereby fixing the ink composition. After the radiation curable phase change ink has been cured, a network has been formed within the ink and the radiation curable ink is then no longer fluid. After curing, the ink composition may no longer become fluid at temperature $T_3$. Furthermore, by fixing the ink composition, the ink layer has become firmly attached to the receiving medium and is not easily removed anymore from the receiving medium. The cured image may have a gloss appearance after curing, a matt gloss appearance or a semi-gloss appearance.

It has been found that the temperature T of the receiving medium influences the gloss of the image after curing. The temperature T of the receiving medium may influence the temperature of the ink droplets after the droplets have been applied onto the receiving medium.

If the temperature T is below a first temperature $T_1$, a gloss image may be obtained. The first temperature $T_1$ may be in the range of from 0° C. to 40° C., preferably from 10° C. to 30° C., more preferably from 15° C. to 25° C.

If the temperature T is above a second temperature $T_2$, a matt image may be obtained. The second temperature $T_2$ may be in the range of from 20° C. to 50° C., preferably from 25° C. to 45° C., more preferably from 30° C. to 40° C.

If the temperature T is in between the first temperature $T_1$ and the second temperature $T_2$, a semi-gloss image may be obtained.

Without wanting to be bound to any theory, it is believed that the temperature of the receiving medium, which may determine the temperature of the droplets applied onto the receiving medium, may determine the physical state of the droplets. The physical state may influence the appearance of the droplets and may thereby influence the gloss level of the printed image after curing.

Thus, the gloss of the image may be tuned by controlling the temperature of the receiving medium. The temperature of the receiving medium may be easily controlled using suitable temperature controlling means. Gloss, matt and semi-gloss images may be obtained using only one type of radiation curable phase change ink composition, without having to change the ink composition. Additionally, no additional overcoat is necessary to obtain a desired gloss level of the printed image.

In an embodiment, the radiation curable phase change ink composition is a radiation curable gelling ink composition, comprising at least one gelling agent. The radiation curable gelling ink composition may be a fluid at a temperature above $T_3$. At or below a temperature $T_3$, the gelling agent may form a gel and by forming the gel, the gelling agent may gel the ink. The ink may then be in a so-called gelled phase.

Hence, the gelling agent may provide the ink with a phase change upon cooling the ink composition to a temperature below $T_3$.

As explained above, the gelled phase may be considered a phase wherein a dynamic equilibrium exists between a solid gellant and a fluid. The gel phase is a dynamic networked assembly of molecular components held together by non-covalent interactions. The networked assembly of molecular components may be formed by the gelling agent. The fluid that is present in the networked assembly formed by the gelling agent may comprise the radiation curable component. In addition, the fluid may comprise additional ink components, such as a photoinitiator, an inhibitor and/or a colorant. Thus, when the droplet is transformed from a fluid into a gel and consequently, spreading of the droplet is prevented, the radiation curable component may still be in the fluid phase. Without wanting to be bound to any theory, it is believed that curing of the ink, which may be achieved by inducing a polymerization reaction to polymerize the radiation curable components, may occur faster if the radiation curable component is in the fluid state compared to the situation where the radiation curable component is in the solid state.

The gelling agent may be suitable selected. The gelling agent may be a component capable of forming a (supra) molecular network.

A number of non-limiting examples of the gelling agent are: ketones such as laurone, stearone, di-n-dodecylketone, pyristone, 15-nonacosanone, behenone, palmitone, di-n-hexadecylketone; oligo-ester compounds, the oligo-ester compounds being the reaction product of a poly-hydroxy component, such as pentaerythritol or glycerol and an carboxylic acid comprising an alkyl chain, such as stearic acid, palmitic acid, arachidic acid, linoleic acid or myristic acid esters; a long chain terminal alcohol, such as a $C_{10-C40}$ long chain terminal alcohol, for example a $C_{15}$-$C_{30}$ long chain terminal alcohol, such as a $C_{20}$-$C_{25}$ long chain terminal alcohol. Examples of commercially available long chain terminal alcohols are Unilin® waxes, available from Baker Hughes Inc. Further non-limiting examples of gelling agents are long chain terminal carboxylic acid waxes, such as the Unicid® waxes commercially available from Baker Hughes Inc; urethane waxes, such as ADS043 or ADS039 commercially available from American Dye Source Inc. of Baie D'Urfe, Quebec, Canada; waxes occurring in nature, such as candelilla wax, cerilla wax or montan wax; alkyl-ester waxes, such as the Kester Wax K-AE-80, commercially available from Koster Keunen; amide waxes, such as a primary amide wax or a secondary amide wax, for example octadecane amide wax, stearylstrearate or Erucamide; or a reactive wax. Non-limiting examples of reactive waxes are acrylate waxes, such as acrylated alkyl waxes, vinylether waxes, and alkene waxes, such as oleyl arachidate. Examples of commercially available reactive waxes are reactive Licomont® waxes and reactive Ceridust waxes, obtainable from Clariant International Ltd.

In a further embodiment, the at least one gellant is a crystalline gellant. Upon cooling of the ink composition comprising the crystalline gellant to a temperature below $T_3$, a phase change may occur due to gelling of the ink composition. Additionally, the gelling agent may crystallize upon cooling down, resulting in the formation of crystals in the ink. The presence and the properties of the crystals formed in the ink composition upon cooling may influence the gloss of the image formed. Without wanting to be bound to any theory, it is believed that the properties of the crystals may be influenced by the temperature of the receiving medium.

When the ink is ejected, the ink is in a fluid state and hence, the temperature of the ink may be at a temperature above $T_3$. The lower the temperature of the receiving medium, the larger may be the temperature difference between the ejected droplet and the receiving medium. The larger this temperature difference is, the quicker the ink may cool down after an ink droplet has been applied onto the receiving medium. The quicker the ink cools down, the quicker crystallization takes place. Crystallization is believed to comprise two steps. First, nucleation may take place. In the nucleation step, crystal nuclei are formed. Afterwards, crystal growth may take place, wherein the crystal nuclei grow and crystals are formed.

If the ink cools down quickly, for example if the temperature of the receiving medium is $T_1$ or lower, and crystallization takes place fast, then the nucleation step may be fast and consequently, many crystal nuclei may be formed. If there are many crystal nuclei in the ink layer applied onto the receiving medium, many small crystals may be present after the ink has cooled down. The many small crystals may provide the image with a high gloss level.

On the other hand, if the ink cools down slowly, for example if the temperature of the receiving medium is $T_2$ or higher, and crystallization takes place slowly, then the nucleation step may be slow and consequently, only few crystal nuclei may be formed. If there are few crystal nuclei in the ink layer applied onto the receiving medium, few large crystals may be present after the ink has cooled down. The few large crystals may provide the image with a low gloss level and a matt image may be obtained.

After the ink has cooled and the crystals are formed, the ink layer may be cured. After curing, the gloss of the image may be fixed and may no longer be influenced by the temperature of the receiving medium.

In summary, using a crystalline gelling agent as a gelling agent in the ink composition may enable to influence gloss efficiently.

Non limiting examples of crystalline gelling agents are ketones such as laurone, stearone, di-n-dodecylketone, pyristone, 15-nonacosanone, palmitone, di-n-hexadecylketone; long chain terminal alcohols, such as a $C_{10-C40}$ long chain terminal alcohol, for example a $C_{15}$-$C_{30}$ long chain terminal alcohol, such as a $C_{20}$-$C_{25}$ long chain terminal alcohol; or urethane waxes or vinylether waxes, such as the commercially available Vectomer® monomers, obtainable from Sigma-Aldrich.

Optionally, two or more crystalline gelling agents may be used in an ink composition. The rate of crystallization of a crystalline gelling agent may not only be influenced by the temperature, but also by the ink composition comprising the crystalline gelling agent. If images are printed using an ink set comprising a plurality of inks, for example a Cyan Magenta Yellow blacK ink set, there may be difference in the ink compositions. For example, the colorants used may be different. The difference in ink composition may cause a difference in crystallization in the several ink compositions of the ink set. This may cause differences in gloss between the several inks used for printing an image, e.g. a full-color image. To obtain images having a uniform gloss, even though a plurality of ink compositions is applied, the type and amount of crystalline gelling agent comprised in each of the respective ink compositions within an ink set may be varied.

In an embodiment, the ink composition further comprises a radiation curable wax.

The radiation curable wax may have gelling properties; i.e. the radiation curable wax may contribute in transforming the ink from a liquid to a gel after cooling down on the receiving medium. When the ink composition is cured, the radiation curable wax may be co-polymerized together with the radiation curable component. Consequently, after curing of the ink composition, the radiation curable wax, which may have gelling properties, is incorporated into the polymerized network and is covalently bound therein. As a consequence, the radiation curable wax cannot migrate out of the cured ink layer after printing and curing, thereby preventing print artifacts.

Any suitable radiation curable wax may be used. Non-limiting examples of radiation curable waxes are waxes comprising a radiation curable functional group, such as an epoxy functional group, an alkylene functional group, an acrylate functional group or a methylacrylate functional group. Preferably, the radiation curable functional group is selected form an acrylate functional group and a methylacrylate functional group. The wax may be for example polyalkylene waxes, polyester waxes, hydroxyl-terminated polyalkylene waxes comprising a radiation curable functional group.

In an embodiment, in step c), curing is done in a post-curing step. In a post-curing step, the ink applied onto the receiving medium is not cured immediately after it has been applied onto the receiving medium, but there may be a time interval in between application of the droplet of the ink on the receiving medium and curing of the droplet of ink. The time interval may be in the range of 0-15 minutes, preferably from 0.1-8 minutes, for example in the range of 0.15 minutes to 4 minutes, more preferably from 0.2 minutes to 2 minutes, for example from 0.3-0.6 minutes.

The post-curing may be performed by suitable curing means, for example a suitable source of radiation. The curing means may be positioned downstream in a direction of paper transport with respect to a print head. By positioning the curing means downstream with regard to the print head, and by moving the receiving medium in a paper transport direction, curing may take place after a certain time interval after application of the ink onto the receiving medium.

In conventional printers configured to print images by applying a radiation curable ink composition, the radiation curable ink is cured immediately when it is applied onto the receiving medium. Such curing may be done e.g. by a suitable source of radiation that is mounted on a carriage that carries the print heads. Thus, when the print head ejects the droplets of the radiation curable ink, the droplets may be exposed immediately to the radiation emitted by the source of radiation and may be cured immediately. If the ink, which is ejected from the print head as a fluid, does not show a significant decrease in viscosity, for example by gelling or solidification of the ink, it may be necessary to cure the droplets of the ink applied onto the receiving medium immediately, to prevent mingling and/or spreading of the droplets.

However, in the method according to the present invention, a radiation curable phase change ink composition is used. Upon formation of the gelled phase, the viscosity of the ink composition may increase. A higher viscosity prevents flow of the droplet and thus, the image applied onto the receiving medium may be stabilized. Thus, in the method according to the present invention, a post-cure step may be applied. Using a post-cure step may have a number of advantages compared to immediate curing. For example, droplets of ink applied onto the receiving medium reside on the medium during a time interval before curing takes place. The receiving medium may be at the pre-determined temperature T. During the time interval in between applications of the ink onto the medium and curing, heat exchange between the ink and the receiving medium may take place. The temperature T may be lower than $T_3$. Consequently, when heat exchange takes place between the receiving medium and the ink, a phase change of the ink may occur. Moreover, after heat exchange has taken place, the ink may be at (approximately) at temperature T. The value of T may determine the level of gloss of the image after the image has been cured. Thus, post-curing may allow the ink to adopt the temperature of the receiving medium, which is a convenient way of controlling the temperature of the ink. By controlling the temperature of the ink in between printing and curing, the gloss of the image resulting after curing may be determined. After curing has taken place, the gloss may no longer be influenced by the temperature of the printed image.

In addition, droplets may be applied on top of another un-cured droplet. In ink jet printing, an image may be build up by applying a predetermined pattern of droplets onto a receiving medium. Not all droplets may be applied simultaneously. Also adjacent droplets may not be applied simultaneously. For example, in a multi-pass print mode and/or in a multi-color printer, wherein each color of ink may be applied by a dedicated print head, a first droplet of ink may be applied on an area of the receiving medium and later on, a second droplet may be applied onto the same area of the receiving medium. The properties, e.g. visual appearance and gloss of an image may depend on whether the first droplet is cured or not when the second droplet is applied next to or on top of the first droplet. If the ink does have phase change properties, then the first droplet may stay on the receiving medium without or with only little spreading during application of the second droplet. After all droplets have been applied onto the receiving medium, the entire image may be cured in the post-cure step.

In a further embodiment, the post-curing step comprises a first post-curing step and a second post-curing step. In this embodiment, the post curing step comprises two sub-steps; i.e. a first post-curing step and a second post-curing step. The first post-curing step and the second post-curing step may be performed subsequently or, alternatively, there may be a time interval between the first post-curing step and the second post-curing step. Both the first and second post-curing step may be performed by suitable curing means. For example, the curing means may be sources of suitable radiation, such as UV radiation. The first post-curing step may be carried out by irradiating the ink with a first source of radiation and the second post-curing step may be carried out by irradiating the ink with a second source of radiation. The characteristics, such as intensity, wavelength, etc, of the radiation emitted by the respective sources of radiation may be the same or different.

Optionally, the wavelength of the radiation emitted by the first source of radiation may be longer than the wave length of the radiation emitted by the second source of radiation. Alternatively or additionally, the intensity of the radiation provided by the first source of radiation may be higher than the wave length of the radiation emitted by the second source of radiation. The intensity of the radiation may be influenced e.g. by the intensity of the radiation source itself, by using radiation absorbing filters or by the distance between the source of radiation and the receiving medium.

When a plurality of droplets is positioned on top of one another, a relatively thick layer of ink may be obtained. It may be difficult to cure such a thick layer of ink in one curing step. A problem that may occur is that at least part of the radiation may not penetrate the entire layer of ink, but only the upper part. In that case, only the upper part of the ink layer may be cured, which may result in artifacts, such as wrinkling. For example, the radiation may be absorbed by colorants present in the ink composition.

In an embodiment, the wavelength of the radiation emitted by the first source of radiation may be different from the wavelength of the radiation of the second source of radiation. Preferably, the wavelength of the first source of radiation is selected such that no or only little radiation is absorbed by the colorant present in the ink.

By suitably selecting the first and second source of radiation, respectively, the curing process may be optimized such that the ink layer is cured evenly throughout the entire thickness of the ink layer.

In an aspect of the invention, a method for determining a temperature T of the receiving medium is provided, the method comprising the steps of:

a. determining a desired gloss level of an image to be printed onto a receiving medium;
b. determining a corresponding temperature T of the receiving medium;
c. controlling the temperature of the receiving medium to be at the temperature T, wherein $T<T_3$;
d. applying droplets of a radiation curable phase change ink composition onto the receiving medium using an ink jet apparatus, the radiation curable phase change ink composition comprising a radiation curable component and the radiation curable phase change ink composition being fluid above a third temperature $T_3$;
e. curing the radiation curable phase change ink composition.

As explained above, the gloss of an image depends on the temperature T of the receiving medium. Thus, when it is desired to apply an image onto a receiving medium having a certain gloss level, it may be determined what job settings, such as temperature of the receiving medium T, are required to achieve the desired gloss level of the image to be printed.

In a first step a, a desired gloss level of an image to be printed may be determined. For example, it may be determined that the image should be a gloss image, having a high gloss, such as a gloss of 80% when measured under an angle of 60° using a micro-TRI gloss device obtained from BYK-Gardner GmbH.

In the second step b, based on the desired gloss level, a corresponding temperature T of the receiving medium may be determined. For example, a database comprising one or more look-up tables may be used, wherein the look-up tables comprises gloss levels provided by an ink composition at different temperatures T of the receiving medium. Using such look-up table, the temperature T of the receiving medium required to obtain the desired gloss for a specific type of ink may be determined. Alternatively, an algorithm may be provided to calculate the temperature T of the receiving medium required to obtain the desired gloss for a specific type of ink.

After the required temperature T has been determined, the temperature of the receiving medium may be determined to be at the desired temperature T, the droplets of ink may be applied to the receiving medium and the ink may be cured, as is also explained above.

In an aspect of the invention, an ink jet apparatus for applying droplets of a radiation curable phase change ink composition onto a receiving medium is provided, the radiation curable phase change ink composition comprising a radiation curable component and the radiation curable phase change ink composition being fluid above a third temperature $T_3$, the ink jet apparatus comprising:

a. a print head for jetting droplets of the radiation curable phase change ink composition
b. holding means for holding the receiving medium during a printing operation;
c. curing means for curing the radiation curable phase change ink composition;
d. temperature regulation means for regulation the temperature of the receiving medium;
e. retrieving means for retrieving a desired gloss level of an image to be printed;
f. control means for controlling the print head, the curing means and the temperature regulation means in accordance with the desired gloss and in accordance with the method according to claim 1.

The ink jet apparatus according to the present invention is thus configured for performing the method according to the present invention.

The ink jet apparatus may comprise suitable retrieving means for retrieving a desired gloss level of an image to be printed. The retrieving means may comprise a computer. The retrieving means may further comprise a user interface. For example, using a user interface, an operator of the ink jet apparatus can select a desired gloss level for a selected print job via the user interface. Alternatively, the gloss may be retrieved from a standard setting of a print job. The desired gloss level may be communicated to the control means.

The control means may control the print head to apply a predetermined image onto the receiving medium. In addition, the control means may control the curing means for curing the radiation curable phase change ink. In addition, the control means may control the temperature regulation means to regulate the temperature of the receiving medium. As mentioned above, the gloss depends on the temperature T of the receiving medium. Thus, when it is desired to apply an image onto a receiving medium having a certain gloss level, it may be determined what job settings, such as temperature T of the receiving medium, are required to achieve the desired gloss level of the image to be printed. The control means may determine the temperature T of the receiving medium corresponding to the desired gloss level. This may be done e.g. by calculating the temperature according to an algorithm stored in the control means. Alternatively, the temperature may be determined using a look-up table, comprising a plurality of temperatures and their corresponding gloss levels. Furthermore, the control means may control the temperature regulation means to regulate the temperature of the receiving medium to be at the desired temperature T. As a result, an image having a predetermined gloss level may be provided. When the temperature of the receiving medium is controlled to be at temperature T, applying droplets of the radiation curable ink onto the receiving medium and curing the droplets of ink, may result in the formation of an image onto the receiving medium, wherein the image has a predetermined level of gloss. Preferably, the temperature T is below temperature $T_3$.

In an embodiment, the curing means comprise a first curing means and a second curing means, said first curing means being configured to perform a first post-curing step and said second curing means being configured to perform a second post-curing step.

The ink jet apparatus according to this embodiment of the invention is thus configured for performing a preferred embodiment of the method according to the present invention.

The curing means may be energy sources, such as actinic radiation sources, accelerated particle sources or heaters. Examples of actinic radiation sources are UV radiation sources or visible light sources. UV radiation sources are preferred, because they are particularly suited to cure UV curable inks by inducing a polymerization reaction in such inks. Examples of suitable sources of such radiation are lamps, such as mercury lamps, xenon lamps, carbon arc lamps, tungsten filaments lamps, light emitting diodes (LED's) and lasers.

The first curing means and the second curing means may be the same type of energy source or may be different type of energy source. For example, when the first and second curing means, respectively both emit actinic radiation, the wavelength of the radiated emitted by the two respective curing means may differ. Additionally or alternatively, the intensity of the radiation emitted by the first curing means and the second curing means may be the same or different.

BRIEF DESCRIPTION OF THE DRAWINGS

These and further features and advantages of the present invention are explained hereinafter with reference to the accompanying drawings showing non-limiting embodiments and wherein.

In the drawings, same reference numerals refer to same elements.

DETAILED DESCRIPTION OF THE DRAWINGS

Figure 1A:
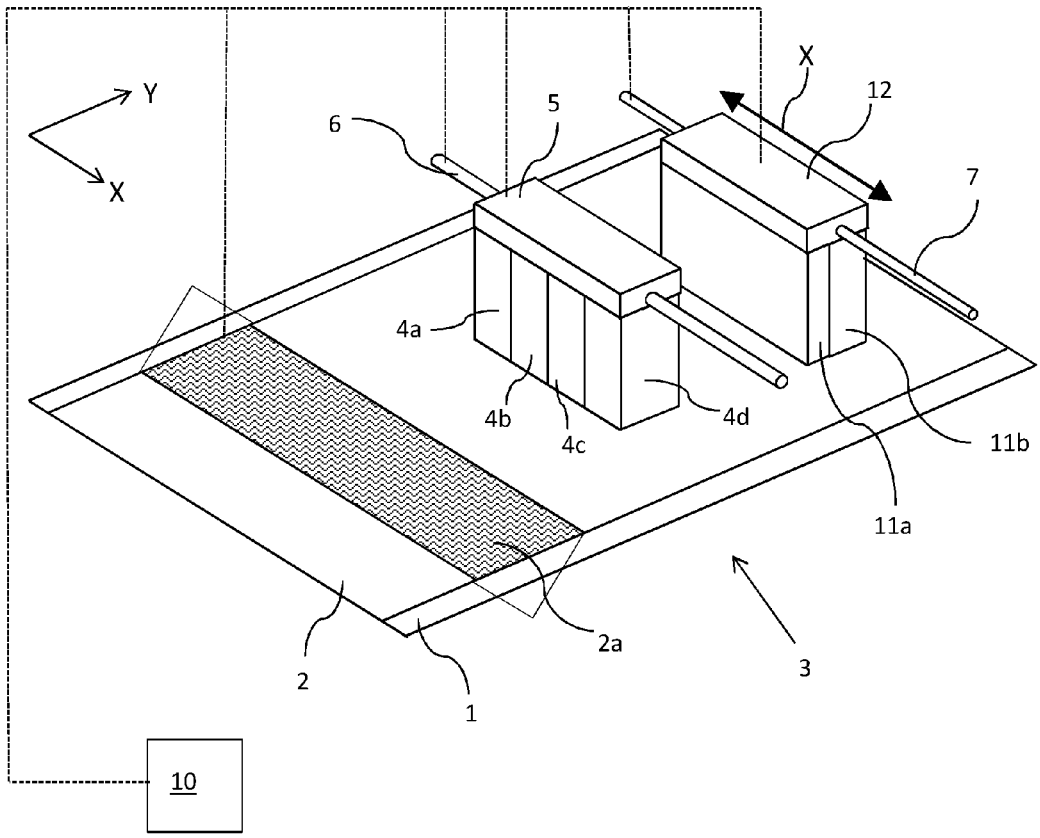
FIG. 1A shows a schematic representation of an inkjet printing system.
Figure 1B:
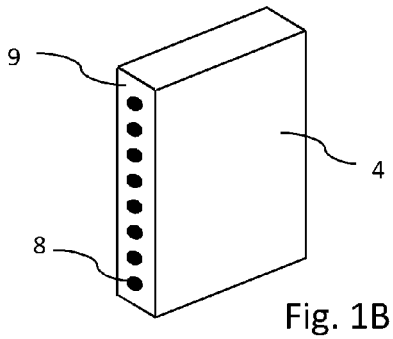
FIG. 1B shows a schematic representation of an inkjet print head.

FIG. 1A shows an ink jet printing assembly 3. The ink jet printing assembly 3 comprises supporting means for supporting an image receiving medium 2. The supporting means are shown in FIG. 1A as a flat surface 1, but alternatively, the supporting means may be a platen, for example a rotatable drum that is rotatable around an axis. The supporting means may be optionally provided with suction holes for holding the image receiving medium in a fixed position with respect to the supporting means. The ink jet printing assembly 3 comprises print heads 4*a*-4*d*, mounted on a scanning print carriage 5. The scanning print carriage 5 is guided by suitable guiding means 6 to move in reciprocation in the main scanning direction X. Each print head 4*a*-4*d* comprises an orifice surface 9, which orifice surface 9 is provided with at least one orifice 8, as is shown in FIG. 1B. The print heads 4*a*-4*d* are configured to eject droplets of marking material onto the image receiving medium 2.

The image receiving medium 2 may be a medium in web or in sheet form and may be composed of e.g. paper, cardboard, label stock, coated paper, plastic or textile. Alternatively, the image receiving medium 2 may also be an intermediate member, endless or not. Examples of endless members, which may be moved cyclically, are a belt or a drum. The image receiving medium 2 is moved in the sub-scanning direction Y over the flat surface 1 along four print heads 4*a*-4*d* provided with a fluid marking material.

The image receiving medium 2, as depicted in FIG. 1A is locally heated or cooled in the temperature control region 2*a*. In the temperature control region 2A, temperature control means (not shown), such as heating and/or cooling means may be provided to control the temperature of the receiving medium 2. Optionally, the temperature control means may be integrated in the supporting means for supporting an image receiving medium 2. The temperature control means may be electrical temperature control means. The temperature control means may use a cooling and/or heating liquid to control the temperature of the image receiving medium 2. The temperature control means may further comprise a sensor (not shown) for monitoring the temperature of the image receiving medium 2.

A scanning print carriage 5 carries the four print heads 4*a*-4*d* and may be moved in reciprocation in the main scanning direction X parallel to the platen 1, such as to enable scanning of the image receiving medium 2 in the main scanning direction X. Only four print heads 4*a*-4*d* are depicted for demonstrating the invention. In practice an arbitrary number of print heads may be employed. In any case, at least one print head 4*a*-4*d* per color of marking material is placed on the scanning print carriage 5. For example, for a black-and-white printer, at least one print head 4*a*-4*d*, usually containing black marking material is present. Alternatively, a black-and-white printer may comprise a white marking material, which is to be applied on a black image-receiving medium 2. For a full-color printer, containing multiple colors, at least one print head 4*a*-4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print carriage 5 compared to print heads 4*a*-4*d* containing marking material in any of the other colors. Alternatively, the print head 4*a*-4*d* containing black marking material may be larger than any of the print heads 4*a*-4*d*, containing a differently colored marking material.

The carriage 5 is guided by guiding means 6. These guiding means 6 may be a rod as depicted in FIG. 1A. Although only one rod 6 is depicted in FIG. 1A, a plurality of rods may be used to guide the carriage 5 carrying the print heads 4. The rod may be driven by suitable driving means (not shown). Alternatively, the carriage 5 may be guided by other guiding means, such as an arm being able to move the carriage 5. Another alternative is to move the image receiving material 2 in the main scanning direction X.

Each print head 4*a*-4*d* comprises an orifice surface 9 having at least one orifice 8, in fluid communication with a pressure chamber containing fluid marking material provided in the print head 4*a*-4*d*. On the orifice surface 9, a number of orifices 8 is arranged in a single linear array parallel to the sub-scanning direction Y, as is shown in FIG. 1B, Alternatively, the nozzles may be arranged in the main scanning direction X. Eight orifices 8 per print head 4*a*-4*d* are depicted in FIG. 1B, however obviously in a practical embodiment several hundreds of orifices 8 may be provided per print head 4*a*-4*d*, optionally arranged in multiple arrays.

As depicted in FIG. 1A, the respective print heads 4*a*-4*d* are placed parallel to each other. The print heads 4*a*-4*d* may be placed such that corresponding orifices 8 of the respective print heads 4*a*-4*d* are positioned in-line in the main scanning direction X. This means that a line of image dots in the main scanning direction X may be formed by selectively activating up to four orifices 8, each of them being part of a different print head 4*a*-4*d*. This parallel positioning of the print heads 4*a*-4*d* with corresponding in-line placement of the orifices 8 is advantageous to increase productivity and/or improve print quality. Alternatively multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction X. The image dots are formed by ejecting droplets of marking material from the orifices 8.

The ink jet printing assembly 3 may further comprise curing means 11*a*, 11*b*. As shown in FIG. 1A, a scanning print carriage 12 carries the two curing means 11*a*, 11*b* and may be moved in reciprocation in the main scanning direction X parallel to the platen 1, such as to enable scanning of the image receiving medium 2 in the main scanning direction X. Alternatively, only one or more than two curing means may be applied. It is also possible to apply page-wide curing means. If page-wide curing means are provided, then it may not be necessary to move the curing means in reciprocation in the main scanning direction X.

The carriage 12 is guided by guiding means 7. These guiding means 7 may be a rod as depicted in FIG. 1A. Although only one rod 7 is depicted in FIG. 1A, a plurality of rods may be used to guide the carriage 12 carrying the print heads 11. The rod 7 may be driven by suitable driving means (not shown). Alternatively, the carriage 12 may be guided by other guiding means, such as an arm being able to move the carriage 12.

The curing means may be energy sources, such as actinic radiation sources, accelerated particle sources or heaters. Examples of actinic radiation sources are UV radiation sources or visible light sources. UV radiation sources are preferred, because they are particularly suited to cure UV curable inks by inducing a polymerization reaction in such inks. Examples of suitable sources of such radiation are lamps, such as mercury lamps, xenon lamps, carbon arc lamps, tungsten filaments lamps, light emitting diodes (LED's) and lasers. In the embodiment shown in FIG. 1A, the first curing means 11*a* and the second curing means 11*b* are positioned parallel to one another in the sub scanning direction Y. The first curing means 11*a* and the second curing means 11*b* may be the same type of energy source or may be different type of energy source. For example, when the first and second curing means 11*a*, 11*b*, respectively both emit actinic radiation, the wavelength of the radiated emitted by the two respective curing means 11*a*, 11*b* may differ. Additionally or alternatively, the intensity of the radiation emitted by the first curing means 11*a* and the second curing means 11*b* may be the same or different. The curing means 11 are positioned downstream with regard to the print heads 4 in the paper transport direction Y.

The flat surface 1, the temperature control means, the carriage 5, the print heads 4*a*-4*d*, the carriage 12 and the first and second curing means 11*a*, 11*b* are controlled by suitable controlling means 10. The controlling means 10 may comprise a computer and/or a user interface. In addition, ink jet printing assembly 3 may comprise retrieving means for retrieving a desired gloss level of an image to be printed. For example, the retrieving means may comprise a user interface where an operator of the ink jet printing assembly 3 can input a desired gloss level. The user interface may comprise a display unit and a control panel. Alternatively, the control panel may be integrated in the display unit, for example in the form of a touch-screen control panel. The local user interface unit is connected to a controlling means 10 placed inside the printing apparatus. The controller, for example a computer, comprises a processor adapted to issue commands to the print engine, for example for controlling the print process. The image forming assembly 3 may optionally be connected to a network The image forming apparatus 36 may receive printing jobs via the network. Further, optionally, the controller of the printer may be provided with a USB port, so printing jobs may be sent to the printer via this USB port.

EXPERIMENTS AND EXAMPLES

Materials

All chemicals were used as received.

Methods

Gloss

The gloss of an image was measured after the image had been printed and cured. The gloss was measured using a micro-TRI gloss device obtained from BYK-Gardner GmbH. The micro-TRI gloss measuring device simultaneously measures the gloss under an angle of 20°, 60° and 85°, respectively. The gloss level reported is the gloss level measured under an angle of 60°. The gloss is measured in a direction parallel to the direction of printing (direction of paper transport during a print job).

A gloss level of 75% or more is considered a gloss image. A gloss level of between 75% and 25% is considered a semi-gloss image. A gloss image of 25% or less is considered a matt image.

Experiment 1

Preparation of Ink Composition 30 gram of propoxylated neopentyl glycol diacrylate (SR 9003 obtainable from Sartomer) and 30 gram of di-trimethylolpropane tetraacrylate (SR 355 obtainable from Sartomer), 8 gram of the binder according to example 2 of EP 1367103, 17 gram of N-vinylcaprolactam (BASF), 0.4 gram of stearone (Alfa Aesar), 0.4 gram of TP Licomont ER 165 (Clariant), 4 gram of Irgacure 379 (BASF), 2 gram of Genocure ITX, 2 gram of Genocure EPD, 3 gram of Genorad 18 (all obtainable from Rahn A.G.), 1 gram of Tegorad 2250 (Evonik) and 2 grams of Black Pigment (Mikuni) were put together in a flask and mixed, resulting in ink composition 1.

Printing

Prints were made using an Oce Colorwave 600 printer. Hello matt, 150 gr $m^{-2}$ (BührmannUbbens) was used as the receiving medium and ink composition 1 was used as the ink. Prints were made in a 1 pass print mode. The print was cured using a Nordson V-bulb, which was positioned at a height of 4 cm with respect to the receiving medium.

The temperature of the receiving medium was measured using a Raynger ST8-Pro Plus Infrared thermometer obtainable from Raytek.

Figure 2:
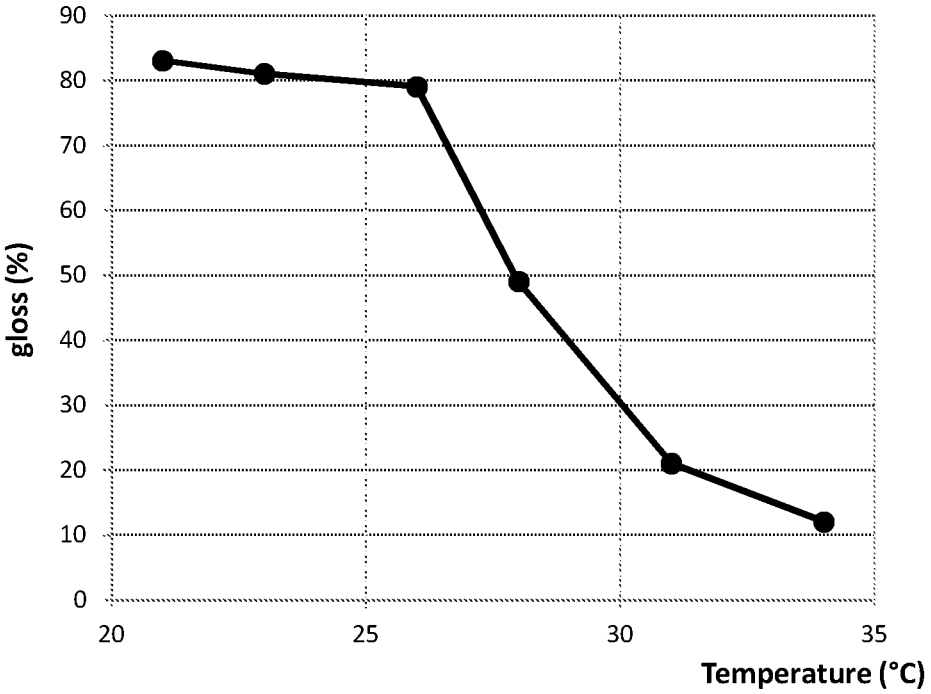
FIG. 2 illustrates an example of the temperature dependency of the gloss of an image.

FIG. 2 shows the influence of the temperature of the receiving medium on the gloss of the image obtained in printing experiment 1. As is shown in FIG. 2, the gloss of the image is not constant, but depends on the temperature of the receiving medium. At lower temperatures, a gloss image is obtained. For example, if the temperature of the receiving medium is 21° C., then an image having a gloss of 83 was obtained, which is a gloss image. At increasing temperatures of the receiving medium, the gloss decreases, although initially the decrease is only minor. At a receiving medium temperature of 26° C., an image having a gloss of 79 was obtained. An image having a gloss of 79% is still considered a gloss image. However, as the temperature is further increases, the gloss level of the printed image decreases further; at a receiving medium temperature of 28° C., an image having a gloss level of 49% is obtained, which is a semi-gloss image.

As the receiving medium temperature is even further increased, a matt image is obtained. At receiving medium temperatures of 31° C. and 34° C., images having a gloss level of 21% and 12%, respectively, are obtained.

Thus, FIG. 2 shows that the gloss of the image obtained can be influenced by controlling the receiving medium temperature. As is shown in FIG. 2, at temperatures of 26° C. or below, gloss images are obtained. At receiving medium temperatures of 30° C. or higher, matt images are obtained, whereas at receiving medium temperatures of in between 26° C. and 30° C., semi-gloss images are obtained.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually and appropriately detailed structure. In particular, features presented and described in separate dependent claims may be applied in combination and any combination of such claims are herewith disclosed. Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention claimed is:

1. Method for applying an image onto a receiving medium, the method comprising the steps of:

a. applying droplets of a radiation curable phase change ink composition onto a receiving medium using an ink jet apparatus, the radiation curable phase change ink composition comprising a radiation curable component and the radiation curable phase change ink composition being fluid above a third temperature $T_3$;

b. controlling the temperature of the receiving medium to be at a temperature T, wherein $T<T_3$; and c. curing the radiation curable phase change ink composition;

wherein, if the temperature T is in between a first temperature $T_1$ and a second temperature $T_2$, a semi-gloss print is obtained;

if $T \leq T_1$, a gloss print is obtained;

if $T \geq T_2$, a matt print is obtained;

wherein $T_1<T_2<T_3$, wherein the radiation curable phase change ink composition is a radiation curable gelling ink composition comprising at least one gelling agent and wherein the at least one gelling agent is a crystalline wax.

2. The method according to claim 1, wherein the ink composition further comprises a radiation curable wax.

3. The method according to claim 1, wherein in step c), curing is done in a post-curing step.

4. The method according to claim 3, wherein the post-curing step comprises a first post-curing step and a second post-curing step.

5. An ink jet apparatus for applying droplets of a radiation curable phase change ink composition onto a receiving medium, the radiation curable phase change ink composition comprising a radiation curable component and the radiation curable phase change ink composition being fluid above a third temperature $T_3$, the ink jet apparatus comprising:

a. a print head for jetting droplets of the radiation curable phase change ink composition;

b. holding means for holding the receiving medium during a printing operation;

c. curing means for curing the radiation curable phase change ink composition;

d. temperature regulation means for regulation the temperature of the receiving medium to be at a temperature T, wherein $T<T_3$;

e. retrieving means for retrieving a desired gloss level of an image to be printed; and f. control means for controlling the print head, the curing means and the temperature regulation means in accordance with the desired gloss and in accordance with the method according to claim 1.

6. The ink jet apparatus according to claim 5, wherein the curing means comprise a first curing means and a second curing means, said first curing means being configured to perform a first post-curing step and said second curing means being configured to perform a second post-curing step.

7. The ink jet apparatus according to claim 5, wherein the radiation curable phase change ink composition is a radiation curable gelling ink composition comprising at least one gelling agent and wherein the at least one gelling agent is a crystalline wax.

* * * * *